US007666026B2

(12) United States Patent
Takehara

(10) Patent No.: US 7,666,026 B2
(45) Date of Patent: Feb. 23, 2010

(54) ELECTRICAL CONNECTOR INCLUDING A CONNECTOR HAVING A FIT DETECTION PORTION

(75) Inventor: Hideaki Takehara, Hitachi (JP)

(73) Assignee: Hitachi Cable, Ltd., Chiyoda-ku, Tokyo (JP)

( * ) Notice: Subject to any disclaimer, the term of this patent is extended or adjusted under 35 U.S.C. 154(b) by 0 days.

(21) Appl. No.: 12/314,305

(22) Filed: Dec. 8, 2008

(65) Prior Publication Data

US 2009/0286418 A1 Nov. 19, 2009

(30) Foreign Application Priority Data

May 14, 2008 (JP) ..... 2008-126700

(51) Int. Cl.
*H01R 3/00* (2006.01)

(52) U.S. Cl. ..... 439/489

(58) Field of Classification Search ..... 439/352, 439/489, 488, 752
See application file for complete search history.

(56) References Cited

U.S. PATENT DOCUMENTS

| | | | | |
|---|---|---|---|---|
| 3,944,316 A | | 3/1976 | Newman et al. | 439/181 |
| 4,211,457 A | | 7/1980 | Meadows | 439/192 |
| 5,464,353 A | * | 11/1995 | Saijo et al. | 439/489 |
| 5,613,872 A | * | 3/1997 | Fukuda et al. | 439/489 |
| 5,863,216 A | * | 1/1999 | Tsuji et al. | 439/489 |
| 6,086,411 A | * | 7/2000 | Shinozaki | 439/489 |
| 6,824,417 B1 | | 11/2004 | Nimura | 439/352 |
| 7,438,570 B2 | | 10/2008 | Mori et al. | 439/157 |
| 2005/0032404 A1 | | 2/2005 | Furuta et al. | 439/157 |

FOREIGN PATENT DOCUMENTS

| | | |
|---|---|---|
| JP | 2002-343506 | 11/2002 |
| JP | 2004-63090 | 2/2004 |
| JP | B-3820355 | 6/2006 |

* cited by examiner

*Primary Examiner*—Javaid Nasri
(74) *Attorney, Agent, or Firm*—McGinn IP Law Group, PLLC

(57) ABSTRACT

An electrical connector includes a first connector including a first interlock terminal, a first connecting terminal, and a first interlock connector for holding the first interlock terminal, and a second connector including a second interlock terminal electrically connected to the first interlock terminal, and a second connecting terminal engaged with the first connecting terminal. The second connector further includes a second interlock connector engaged with the first interlock connector and holding the second interlock terminal, and a fit detecting portion movable in conjunction with the second interlock connector for detecting a fit state of the first connector and the second connector.

16 Claims, 4 Drawing Sheets

ELECTRICAL CONNECTOR INCLUDING A CONNECTOR HAVING A FIT DETECTION PORTION

The present application is based on Japanese Patent Application No. 2008-126700 filed on May 14, 2008, the entire contents of which are incorporated herein by reference.

BACKGROUND OF THE INVENTION

1. Field of the Invention

The present invention relates to an electrical connector and, in particular, to an electrical connector that can detect a fit state of male and female connectors.

2. Related Art

A conventional electrical connector is known which has a first connector with a locking arm along an outer surface of a housing, a second connector fixed to the first connector by the locking arm while being engaged with the first connector, a detection member provided between the housing and the locking arm for detecting whether or not the first connector is suitably engaged with (or fitted in) the second connector, and a locking projection on an inner surface of the locking arm for holding the detection member at a standby position (See, e.g., JP-A 2004-63090).

In the electrical connector of JP-A 2004-63090, since the locking arm and the detection member are fixed by the locking projection in projected form, it is possible to keep the strength of the locking arm, as compared to the case that an opening as a locking means is formed penetrating from an outer surface to an inner surface of the locking arm.

However, the electrical connector of JP-A-2004-63090 has the problem that, in case of disengaging the female connector from the male connector while feeding current, the current-carrying between the terminals of the male and female connectors continues until the terminals of the male and female connectors are disconnected, so that the surface of the terminals of the male and female connectors deteriorates and the current-carrying property of the connectors lowers.

SUMMARY OF THE INVENTION

It is an object of the invention to provide an electrical connector that allows safe engagement or disengagement between a male connector and a female connector while surely stopping current feed between the male and female connectors by detecting a fit state between the male and female connectors.

(1) According to one embodiment of the invention, an electrical connector comprises:

a first connector comprising a first interlock terminal, a first connecting terminal, and a first interlock connector for holding the first interlock terminal; and a second connector comprising a second interlock terminal electrically connected to the first interlock terminal, and a second connecting terminal engaged with the first connecting terminal, wherein the second connector further comprises a second interlock connector engaged with the first interlock connector and holding the second interlock terminal, and a fit detecting portion movable in conjunction with the second interlock connector for detecting a fit state of the first connector and the second connector.

(2) According to another embodiment of the invention, an electrical connector comprises:

a male connector comprising an interlock female terminal, a male terminal, and an interlock male connector for holding the interlock female terminal; and a female connector comprising an interlock male terminal electrically connected to the interlock female terminal, and a female terminal fitted with the male terminal, wherein the female connector comprising an interlock female connector engaged with the interlock male connector and holding the interlock male terminal, a rod connected to the interlock female connector, and a fit detecting portion movable in conjunction with the interlock female connector via the rod for detecting a fit state of the male connector and the female connector.

In the above embodiments (1) and (2), the following modifications and changes can be made.

(i) The fit detecting portion is connected to the second interlock connector via a rod.

(ii) The rod comprises a plurality of rods.

(iii) The fit detecting portion is connected to the second interlock connector via divided rods.

(iv) The rod comprises a packing disposed between the fit detecting portion and the second interlock connector.

BRIEF DESCRIPTION OF THE DRAWINGS

Next, the present invention will be explained in more detail in conjunction with appended drawings, wherein.

DESCRIPTION OF THE PREFERRED EMBODIMENTS

Embodiment

Figure 1:
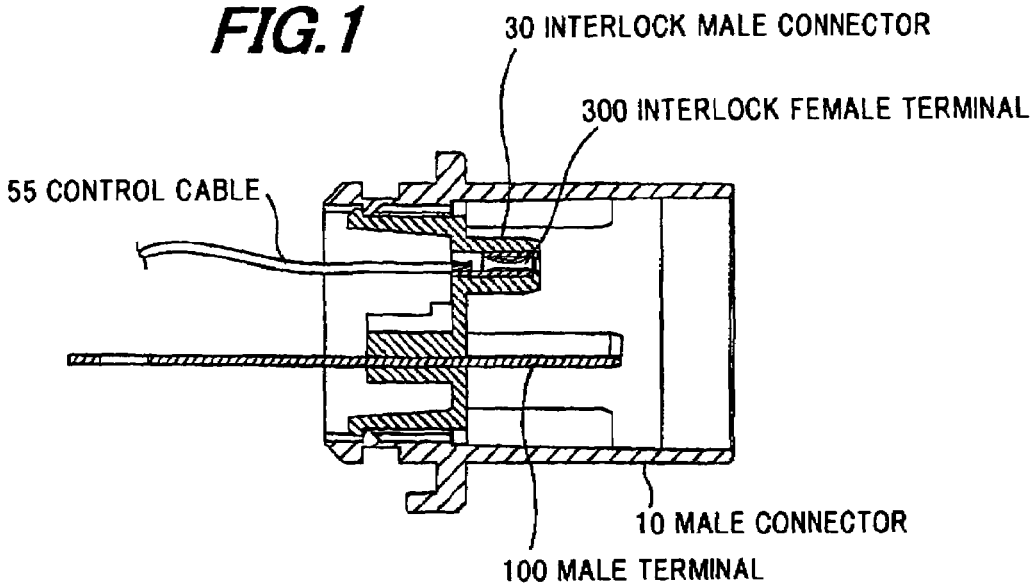
FIG. 1 is a cross sectional view showing a male connector of an electrical connector in a preferred embodiment of the invention.
Figure 2:
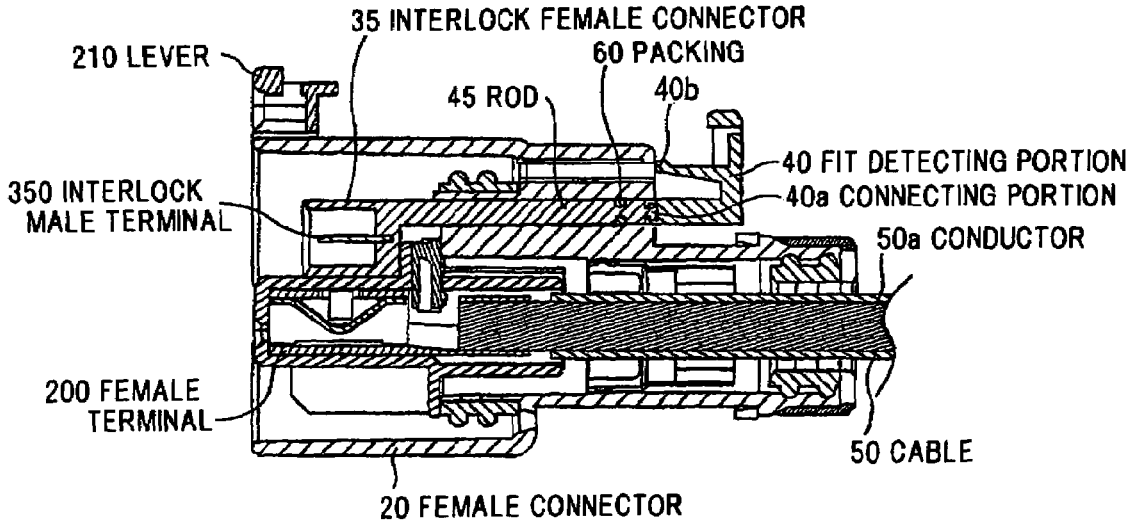
FIG. 2 is a cross sectional view showing a female connector of the electrical connector of the embodiment.

FIG. 1 shows the schematic construction of a male connector of an electrical connector in the preferred embodiment according to the present invention. FIG. 2 shows the schematic construction of a female connector of the electrical connector in the embodiment.

The electrical connector of the embodiment is composed of a male connector 10 as a first connector, and a female connector 20 as a second connector having a shape corresponding to an outer peripheral shape of the male connector 10. The electrical connector of the embodiment is assembled by engaging the male connector 10 with the female connector 20.

Construction of Male Connector 10

As shown in FIG. 1, the male connector 10 is composed of a male terminal 100 as a first connecting terminal (a portion of a main current-carrying terminal), an interlock male connector 30 as a first interlock connector which holds an interlock female terminal 300 as a first interlock terminal, and a control cable 55 as an interlock control cable electrically connected to the interlock female terminal 300. The interlock male connector 30 is fitted in (or engaged with) and fixed to a housing of the male connector 10.

As an example, the male connector 10 is formed such that the interlock male connector 30 is fitted in one end of the housing formed in a substantially tubular shape, and an opening is provided at the other end of the housing. The interlock male connector 30 is provided with a hole penetrating along the longitudinal direction of the male connector 10, and the interlock female terminal 300 is formed inside the hole. The interlock female terminal 300 is electrically connected to the control cable 55 inside the hole. The control cable 55 is connected to a control device (not shown) which controls current fed to a cable 50 of the electrical connector. Furthermore, the male terminal 100 has an exposed portion to be electrically connected to a female terminal 200 at the side of the opening.

Construction of Female Connector 20

As shown in FIG. 2, the female connector 20 is composed of a female terminal 200 as a second connecting terminal (a portion of a main current-carrying terminal), a cable 50 including a conductor 50*a* crimpingly connected to the female terminal 200, an interlock female connector 35 holding an interlock male terminal 350 as a second interlock terminal, a rod 45 connected to the interlock female connector 35, a fit detecting portion 40 connected to the rod 45 via a connecting portion 40*a*, a packing 60 provided at a contact portion of the rod 45 with the female connector 20 between the fit detecting portion 40 and the interlock female connector 35, and a lever 210 for fixing the male connector 10 and the female connector 20 which are engaged with each other by moving along a suitably-shaped guide (not shown) provided outside the housing of the female connector 20.

As an example, the female connector 20 is provided with a housing formed substantially tubular. At one end of the housing, the female terminal 200 as a main current-carrying terminal of the electrical connector extending toward another end (an opening side) of the housing is fixed, and a through hole is provided at a predetermined portion of the other end. The interlock female connector 35 is connected to the rod 45 and the rod 45 is connected to the fit detecting portion 40 via the through hole. The rod 45 and the fit detecting portion 40 are connected at the connecting portion 40*a*. Furthermore, a projecting portion 40*b* of the fit detecting portion 40 is formed insertably into a hole provided at a predetermined position of the housing of the female connector 20. Concretely, the projecting portion 40*b* of the fit detecting portion 40 is allowed to slide into the hole by lowering a lever 40*d* of the fit detecting portion 40 toward the rod 45 side. In this state, the fit detecting portion 40 is slidable.

Furthermore, for the purpose of preventing the mixture of a foreign substance from the outside such as water droplet or the like, the rod 45 has the packing 60 as a rod packing formed of an elastic body at a predetermined position between the fit detecting portion 40 and the interlock female connector 35. For example, a groove corresponding to the packing 60 is formed at a predetermined position of the rod 45, and the packing 60 is inserted into the groove. The packing 60 is provided with an outer peripheral diameter substantially larger than that of the rod 45.

The interlock female connector 35 is provided with an opening in the direction of the opening of the female connector 20. The interlock female connector 35 is connected to the fit detecting portion 40 via the rod 45, and is arranged movably relative to the housing of the female connector 20. As an example, when the fit detecting portion 40 is moved along the longitudinal direction (i.e., the longitudinal direction of the cable 50) of the female connector 20 relative to the housing of the female connector 20, the interlock female connector 35 is moved relative to the housing of the female connector 20 in conjunction with this movement.

The housing of the male connector 10, the housing of the female connector 20, the interlock male connector 30 and the interlock female connector 35 are formed of a synthetic resin material having excellent characteristics such as predetermined mechanical strength, predetermined heat resistance or the like. Similarly, the fit detecting portion 40 and the rod 45 are formed of a synthetic resin material having excellent characteristics such as predetermined mechanical strength, predetermined heat resistance or the like.

Furthermore, the cable 50 is formed by covering the conductor 50*a* as a wire formed of a metallic material such as copper or the like excellent in electrical conductivity (i.e., low resistivity), with a sheath formed of an insulating material. The cable 50 is connected to an external power supply (not shown). The male terminal 100, the female terminal 200, the interlock female terminal 300 and the interlock male terminal 350 each are formed of a metallic material such as copper alloy or the like as a conductive material.

Figure 3:
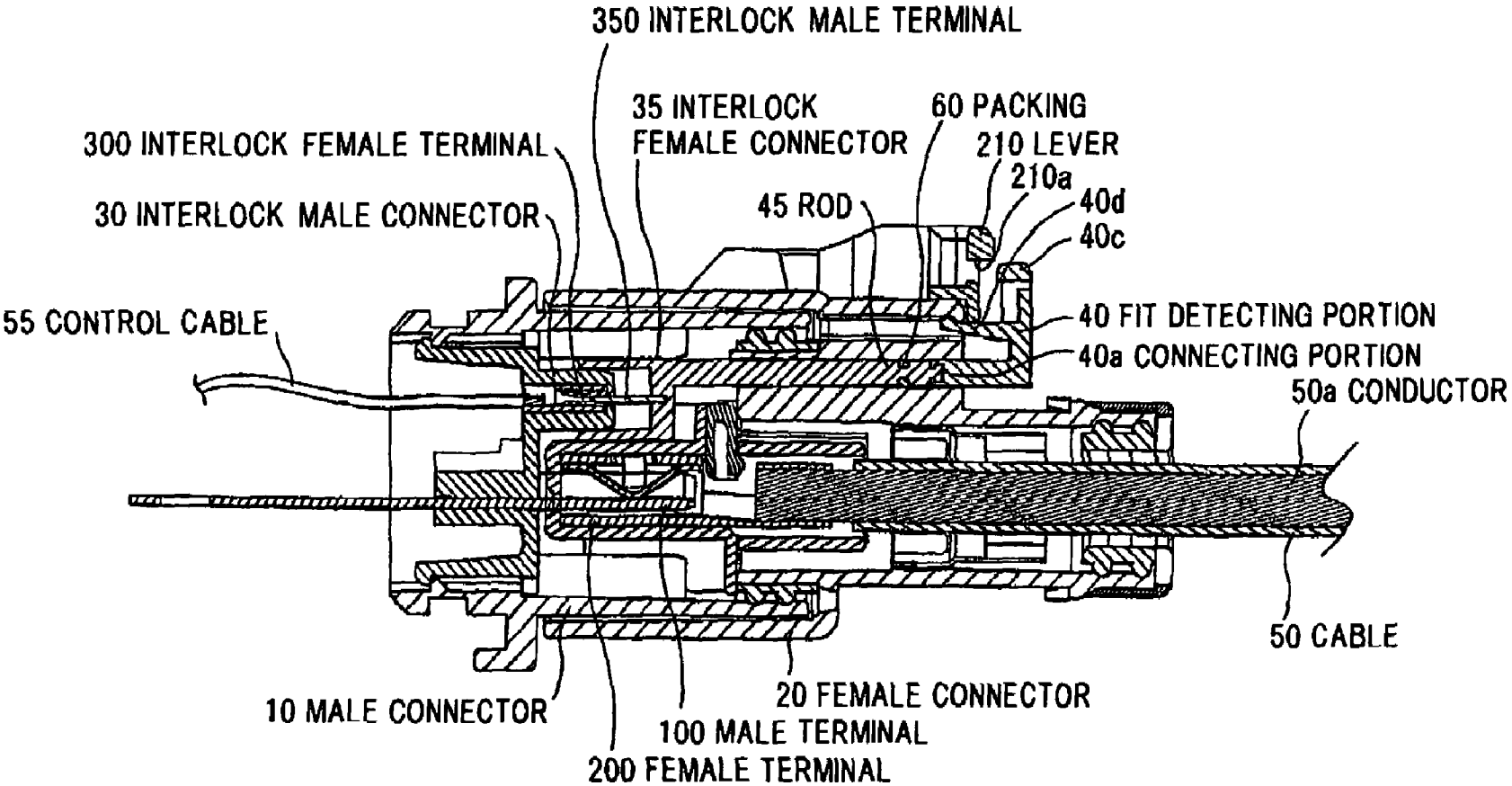
FIG. 3 is a cross sectional view showing the state that the male connector is incompletely engaged with (or fitted in) the female connector in the embodiment.
Figure 4:
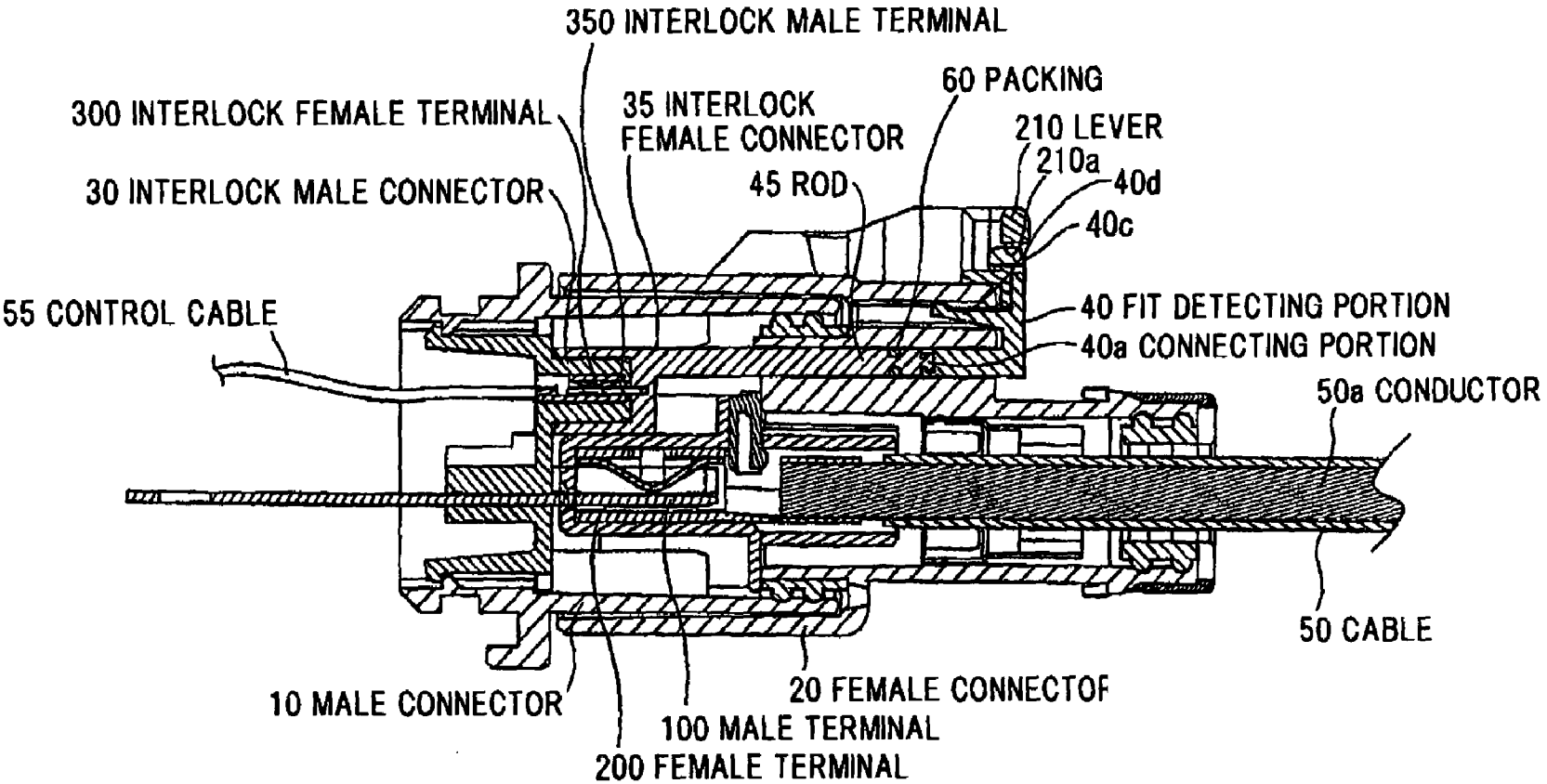
FIG. 4 is a cross sectional view showing the state that the male connector is completely engaged with (or fitted in) the female connector and an interlock male terminal is connected to an interlock female terminal in the embodiment.

FIG. 3 shows a state that the male connector is fitted in the female connector of the embodiment according to the present invention. FIG. 4 shows a state that the male connector is fitted in the female connector and an interlock male terminal is connected to an interlock female terminal of the embodiment according to the present invention.

Operation of the Embodiment

At first, the opening of the male connector 10 is arranged opposite the opening of the female connector 20. Then, as shown in FIG. 3, the male connector 10 is fitted in the female connector 20. Concretely, by inserting the male connector 10 into the opening of the female connector 20, the male terminal 100 is inserted into the female terminal 200. At this moment, the interlock male connector 30 is partially inserted into the interlock female connector 35.

Then, the lever 210 is turned (about a fixed axis) toward the fit detecting portion 40 such that an edge of the lever 210 contacts the lever 40*d* of the fit detecting portion 40. Here, the male connector 10 is fitted in the female connector 20 by being moved in the direction of the female connector 20 according to the rotation of the lever 210 to be inserted into the female connector 20. In this state, where the male terminal 100 is fitted in the female terminal 200, the male terminal 100 is electrically connected to the conductor 50*a* of the cable 50.

However, the interlock male terminal 350 is not yet inserted into the interlock female terminal 300. Namely, in this state, the interlock female terminal 300 is not fitted in the interlock male terminal 350, and the interlock female terminal 300 is kept opened relative to interlock male terminal 350. Thus, in this case, an interlock circuit composed of the interlock female terminal 300 and the interlock male terminal 350 is in open state such that current is not fed between the male terminal 100 and the female terminal 200. Then, the fit detecting portion 40 is moved in the direction for fitting the interlock male connector 30 in the interlock female connector 35.

At this moment, the fit detecting portion 40 detects the fit state. Concretely, the fit detecting portion 40 has a function to detect whether or not the male connector 10 is fitted in the female connector 20. Namely, the fit detecting portion 40 has a function to detect which of the state that the male connector 10 is fitted in the female connector 20 and the state that the male connector 10 is not fitted in the female connector 20. For example, in the process of fitting the male connector 10 in the female connector 20, the fit detecting portion 40 is at an undetected position as shown in FIG. 3. When the male connector 10 is fitted in the female connector 20, the fit detecting portion 40 is allowed to move to a detected position indicating that the male connector 10 is suitably fitted in the female connector 20 as shown in FIG. 4. The undetected position is defined as, e.g., a position where an edge 40*c* of the fit detecting portion 40 is disengaged from an opening 210*a* preformed on the lever 210, and the detected position is defined as, e.g., a position where the edge 40*c* of the fit detecting portion 40 is inserted in the opening 210*a* preformed on the lever 210.

When the male connector 10 is suitably fitted in the female connector 2, the edge 40*c* of the fit detecting portion 40 can be inserted into the opening 210*a* of the lever 210. Namely, when the male connector 10 is not suitably fitted in the female connector 20, for example, when the male terminal 100 is incompletely fitted in the female terminal 200 (i.e., when both are not in a predetermined state to be defined as a fitted state) although the male terminal 100 contacts partially the female terminal 200, the fit detecting portion 40 cannot be moved to the detected position.

In contrast, when the male connector 10 is suitably fitted in the female connector 20, e.g., when the male terminal 100 is completely fitted in the female terminal 200 (i.e., when both are in the predetermined state to be defined as a fitted state), the fit detecting portion 40 can be moved to the detected position.

Herein, the suitable fit between the male connector 10 and the female connector 20 means to include the state that the male connector 10 is completely fitted in the female connector 20, and the movement of the fit detecting portion 40 to the detected position means to include that the fit detecting portion 40 can be moved only when the male connector 10 is completely fitted in the female connector 20.

The fit detecting portion 40 is moved in conjunction with the interlock female connector 35 via the rod 45. Therefore, when the fit detecting portion 40 is moved toward the detected position, the interlock female connector 35 is moved toward the male connector 10 in conjunction with the fit detecting portion 40. Then, the interlock male connector 30 is fitted in the interlock female connector 35 as shown in FIG. 4. As a result, the interlock circuit is closed by the electrical connection between the interlock female terminal 300 and the interlock male terminal 350.

When the interlock circuit is closed, a signal indicating that the interlock female terminal 300 is electrically connected to the interlock male terminal 350 is sent through the control cable 55 to the external control device. The external control device (not shown) receives this signal and judges that the male connector 10 is suitably fitted in the female connector 20. Then, the external control device controls an external power supply (not shown) such that power is supplied from the power supply to the electrical connector of the embodiment.

On the other hand, in separating the mutually fitted male connector 10 and the female connector 20 (i.e., in unplugging the male connector 10 from the female connector 20), at first, the fit detecting portion 40 is moved away from the male connector 10. Thereby, the interlock male terminal 350 is pulled out from the interlock female terminal 300 and the interlock circuit is electrically opened. When the interlock circuit is electrically opened, the external control device with the control cable 55 connected therewith judges that the male connector 10 may be separated from the female connector 20, and it stops to supply power to the electrical connector.

After that, the male connector 10 is separated from the female connector 20 by turning the lever 210 toward the male connector 10 and pulling out the male connector 10 from the female connector 20. In this embodiment, the male connector 10 is separated from the female connector 20 after the interlock circuit is electrically opened to stop supply of power to the conductor 50*a*, so that the male connector 10 can be separated from the female connector 20 without feeding current between the male terminal 100 and the female terminal 200.

Effect of the Embodiment

The electrical connector of the embodiment according to the present invention can close the interlock circuit after detecting the suitable fit between the male connector 10 and the female connector 20 by the fit detecting portion 40. Namely, since the interlock female connector 35 is moved in conjunction with the fit detecting portion 40, the interlock circuit is not closed before the fit detecting portion 40 detects that the male connector 10 is suitably fitted in the female connector 20. Thus, a predetermined signal is not supplied to the external control device through the control cable 55 when the male connector 10 is not suitably fitted in the female connector 20. Therefore, it is possible to prevent the electrical current from being fed to the electrical connector in case of a fit mistake or an incomplete fit etc. As mentioned above, the electrical connector of the embodiment can improve safety in connecting the male connector 10 to the female connector 20.

Furthermore, in the electrical connector of the embodiment, when separating the male connector 10 from the female connector 20, the interlock female connector 35 moving in conjunction with the fit detecting portion 40 moves away from the interlock male connector 30, and the interlock circuit is then opened. Therefore, it is possible to surely stop the current-carrying between the male terminal 100 and the female terminal 200 as main current-carrying terminals before the male terminal 100 is moved relative to the female terminal 200. As a result, it is possible to prevent abnormal heat or arc discharge which may be generated in separating the male terminal 100 from the female terminal 200 while feeding current. Therefore, abnormal friction between the male terminal 100 and the female terminal 200 can be prevented to keep endurance and current-carrying property of the male terminal 100 and the female terminal 200. Furthermore, it is possible to stop supply of current between the male terminal 100 and the female terminal 200 when separating the male connector 10 from the female connector 20. Thus, it is possible to improve safety in separating (or pulling-out) the male connector 10 from the female connector 20.

Modification of the Embodiment

Figure 5:
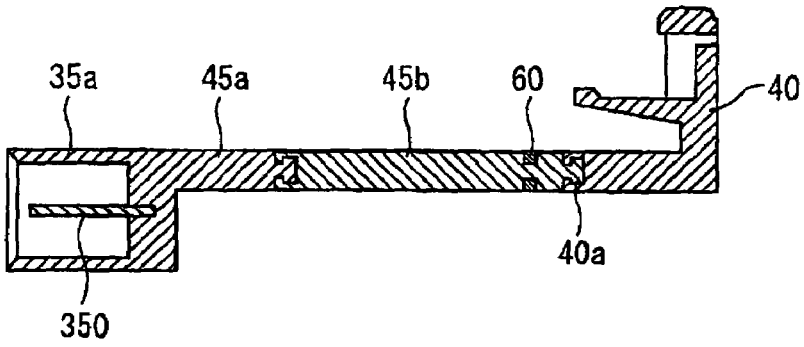
FIG. 5 is a cross sectional view showing an interlock female connector in a modification of the embodiment.

FIG. 5 shows an interlock female connector in a modification of the embodiment according to the present invention.

This modification has substantially the same composition as the interlock female connector of the above embodiment except that the rod is composed of divided rods. Thus, detailed explanation is omitted except on the difference. Also, only the difference is illustrated in FIG. 5.

An interlock female connector 35*a* of the modification is connected to a first rod 45*a*, and the first rod 45*a* is connected with a second rod 45*b* at an opposite edge to the edge connecting with the interlock female connector 35*a*. Namely, one rod is divided into the first rod 45*a* and the second rod 45*b*.

Thus, by using the divided rods composing one rod, it is possible to desirably change the length of the first rod 45*a* and/or the second rod 45*b* as well as the position of the packing 60 with respect to the second rod 45*b*. Thereby, it is possible to shorten the whole length of the rod (i.e., the total length of the first rod 45*a* and the second rod 45*b*). In the modification, although one rod is divided into the two rods, one rod may be divided into three or more rods.

Another Modification of the Embodiment

Figure 6A:
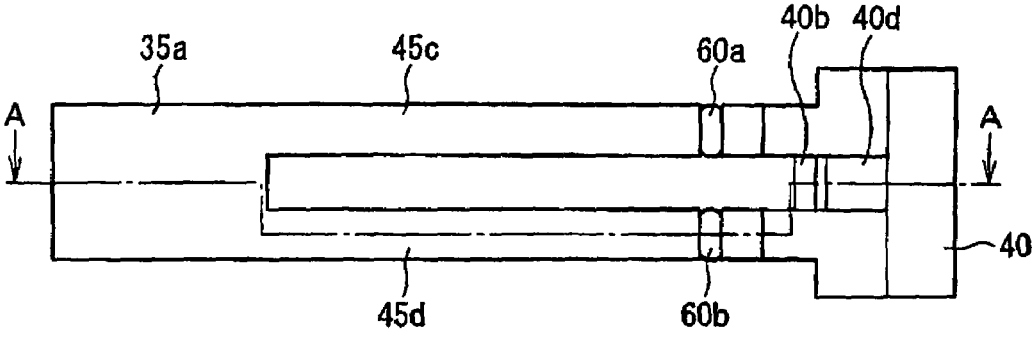
FIGS. 6A and 6B respectively are top and cross sectional views showing an interlock female connector in another modification of the embodiment.
Figure 6B:
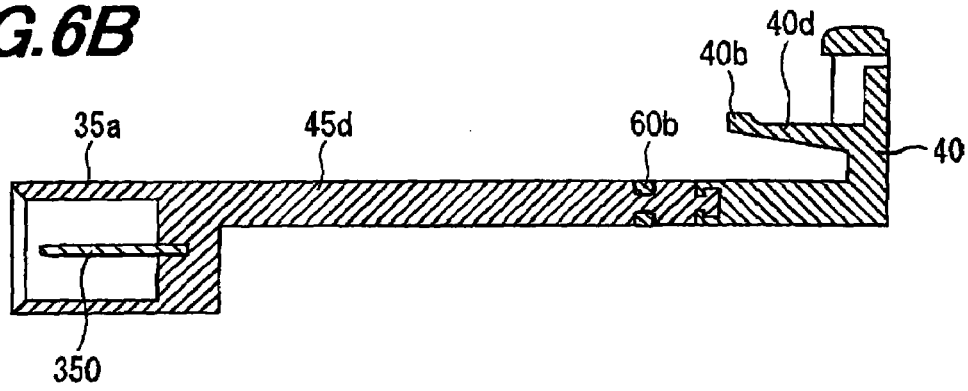

FIG. 6A is a top view of an interlock female connector in another modification of the embodiment according to the present invention and FIG. 6B is a cross sectional view of the interlock female connector in the modification along A-A line in FIG. 6A.

This modification has substantially the same composition as the interlock female connector of the above embodiment except that the rod is composed of plural rods. Thus, detailed explanation is omitted except on the difference. Also, only the difference is illustrated in FIG. 6.

As shown in FIG. 6A, the interlock female connector 35*a* is connected to the fit detecting portion 40 via a rod 45*c* and a rod 45*d* in this modification. Namely, the interlock female connector 35*a* is connected with the fit detecting portion 40 via the plural rods (i.e., the rod 45*c* and the rod 45*d*). In this modification, since the plural of rods are placed at both ends of the interlock female connector in the width direction, it is possible to slide the interlock connector stably.

Other Modification

The packing 60 is provided one each for the rod 45 or the second rod 45*b*. In a further modification of the embodiment, plural packings 60 may be provided on the rod 45 or the second rod 45*b* at predetermined intervals.

Although the embodiment according to the invention has been described, the invention according to claims is not limited by the above described embodiment. Furthermore, it should be noted that not all combinations of the features described in the embodiment is essential for the means to solve the object of the invention.

What is claimed is:

1. An electrical connector, comprising:

a first connector comprising a first interlock terminal, a first connecting terminal, and a first interlock connector for holding the first interlock terminal; and a second connector comprising a second interlock terminal electrically connected to the first interlock terminal, and a second connecting terminal engaged with the first connecting terra, wherein the second connector further comprises:

a second interlock connector which is engaged with the first interlock connector and holds the second interlock terminal, and is arranged inside the second connector and is slidable in a longitudinal direction; and a fit detecting portion movable in conjunction with the second interlock connector for detecting a fit state of the first connector and the second connector, and wherein the second interlock connector is connected to the fit detecting portion via a rod which has a thickness in the width direction which is less than a thickness of the second interlock connector.

2. The electrical connector according to claim 1, wherein the rod comprises a plurality of rods.

3. The electrical connector according to claim 1, wherein the rod comprises plural divided rods, and the fit detecting portion is connected to the second interlock connector via the divided rods.

4. The electrical connector according to claim 1, wherein the rod comprises a packing disposed between the fit detecting portion and the second interlock connector.

5. The electrical connector according to claim 1, wherein the longitudinal direction comprises a longitudinal direction of the second interlock connector.

6. The electrical connector according to claim 1, wherein the first connecting terminal comprises a portion of a main current-carrying terminal and the second connecting terminal comprises a portion of a main current-carrying terminal.

7. The electrical connector according to claim 1, wherein the first connector comprises a housing including a substantially tubular shape and having first and second ends, the first interlock connector being fitted in the first end and an opening being provided in the other end.

8. The electrical connector according to claim 1, wherein the first interlock connector holds a control cable which is electrically connected to the first interlock terminal.

9. The electrical connector according to claim 8, wherein the first interlock connector includes a hole penetrating along the longitudinal direction of the first connector, and the first interlock terminal is formed inside the hole and is electrically connected to the control cable inside the hole.

10. The electrical connector according to claim 9, wherein the second connector comprises another cable including a conductor which is crimpingly connected to the second connecting terminal, the control cable being connected to a control device which controls current fed to the other cable.

11. The electrical connector according to claim 1, wherein the second connector comprises a housing including a substantially tubular shape and having first and second ends, the second connecting teal as a main current-carrying terminal of the electrical connector being fixed at the first end and a through hole being provided at a predetermined portion of the second end.

12. The electrical connector according to claim 11, wherein the second interlock connector is connected to the rod and the rod is connected to the fit detecting portion via the through hole.

13. The electrical connector according to claim 11, wherein the fit detecting portion comprises:

a projecting portion which is formed insertably into another hole in the second end of the housing of the second connector; and a lever, the projecting portion being allowed to slide into the hole by lowering the lever toward a side of the rod.

14. The electrical connector according to claim 11, further comprising:

a lever formed on the housing of the second connector for fixing the first and second connectors.

15. An electrical connector, comprising:

a male connector comprising an interlock female terminal, a male terminal, and an interlock male connector for holding the interlock female terminal; and a female connector comprising an interlock male terminal electrically connected to the interlock female terminal, and a female terminal fitted with the male terminal, wherein the female connector further comprises:

an interlock female connector which is engaged with the interlock male connector and holds the interlock male terminal, and is arranged inside the female connector and is slidable in a longitudinal direction;

a rod connected to the interlock female connector; and a fit detecting portion movable in conjunction with the interlock female connector via the rod for detecting a fit state of the male connector and the female connector, and wherein the female interlock connector is connected to the fit detecting portion via the rod which has a thickness in the width direction which is less than a thickness of the female interlock connector.

16. A female connector for an electrical connector having a male connector including an interlock female terminal, a male terminal, and an interlock male connector for holding the interlock female terminal, the female connector comprising:

an interlock male terminal electrically connected to the interlock female terminal, and a female terminal fitted with the male terminal, an interlock female connector which is engaged with the interlock male connector and holds the interlock male terminal, and is arranged inside the female connector and is slidable in a longitudinal direction of the interlock female connector;

a rod having a thickness in the width direction which is less than a thickness of the female interlock connector, the female interlock connector being connected to the fit detecting portion via the rod; and a fit detecting portion movable in conjunction with the interlock female connector via the rod for detecting a fit state of the male connector and the female connector.

* * * * *

UNITED STATES PATENT AND TRADEMARK OFFICE

CERTIFICATE OF CORRECTION

PATENT NO. : 7,666,026 B2
APPLICATION NO. : 12/314305
DATED : February 23, 2010
INVENTOR(S) : Hideaki Takehara It is certified that error appears in the above-identified patent and that said Letters Patent is hereby corrected as shown below:

In the title (54), replace "ELECTRICAL CONNECTOR INCLUDING A CONNECTOR HAVING A FIT DETECTION PORTION" with "ELECTRICAL CONNECTOR INCLUDING A CONNECTOR HAVING A FIT DETECTING PORTION".

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,666,026 B2
APPLICATION NO. : 12/314305
DATED : February 23, 2010
INVENTOR(S) : Hideaki Takehara It is certified that error appears in the above-identified patent and that said Letters Patent is hereby corrected as shown below:

Title Page, Item (54) and at Column 1, lines 1-3, in the title, replace "ELECTRICAL CONNECTOR INCLUDING A CONNECTOR HAVING A FIT DETECTION PORTION" with "ELECTRICAL CONNECTOR INCLUDING A CONNECTOR HAVING A FIT DETECTING PORTION".

This certificate supersedes the Certificate of Correction issued May 11, 2010.

Signed and Sealed this

Fifteenth Day of June, 2010

David J. Kappos

David J. Kappos
*Director of the United States Patent and Trademark Office*